US005361832A

United States Patent [19]

Van Winkle

[11] Patent Number: 5,361,832

[45] Date of Patent: Nov. 8, 1994

[54] ANNULAR PACKER AND INSERT

[75] Inventor: D. Wayne Van Winkle, Houston, Tex.

[73] Assignee: Drexel Oilfield Services, Inc., Conroe, Tex.

[21] Appl. No.: 79,649

[22] Filed: Jun. 17, 1993

[51] Int. Cl.[5] ..... E21B 33/03

[52] U.S. Cl. ..... 166/84; 175/195; 277/31

[58] Field of Search ..... 166/196, 202, 203, 179, 166/180, 188, 84, 88; 277/31; 251/1.2

[56] References Cited

U.S. PATENT DOCUMENTS

| | | | |
|---|---|---|---|
| 2,731,281 | 1/1956 | Knox | 286/16.1 |
| 2,904,357 | 9/1959 | Knox | 286/16.1 |
| 3,587,734 | 6/1971 | Shaffer | 166/0.5 |
| 4,098,341 | 7/1978 | Lewis | 43/00 |
| 4,460,149 | 7/1984 | Schaeper et al. | 33/06 |
| 4,602,794 | 7/1986 | Schaeper et al. | 15/12 |
| 4,657,263 | 4/1987 | Hynes et al. | 15/12 |
| 5,279,365 | 1/1994 | Yenulis et al. | 166/84 |

*Primary Examiner*—William P. Neuder
*Attorney, Agent, or Firm*—Jack W. Hayden

[57] ABSTRACT

An annular packer (P) with an axial bore (21) includes an elastomer body (23) with inserts (22) partially embedded therein and spaced circumferentially about the axial bore (21). The inserts (22) each support an element (24') embedded in the elastomer body (23) which move into the axial packer bore (21) beyond the inserts when an external compressive force is applied to the elastomer body to reduce the diameter of the axial bore (21) and to provide support for and inhibit extrusion of the elastomer body (23) that is moved into the axial bore by the compressive force.

32 Claims, 6 Drawing Sheets

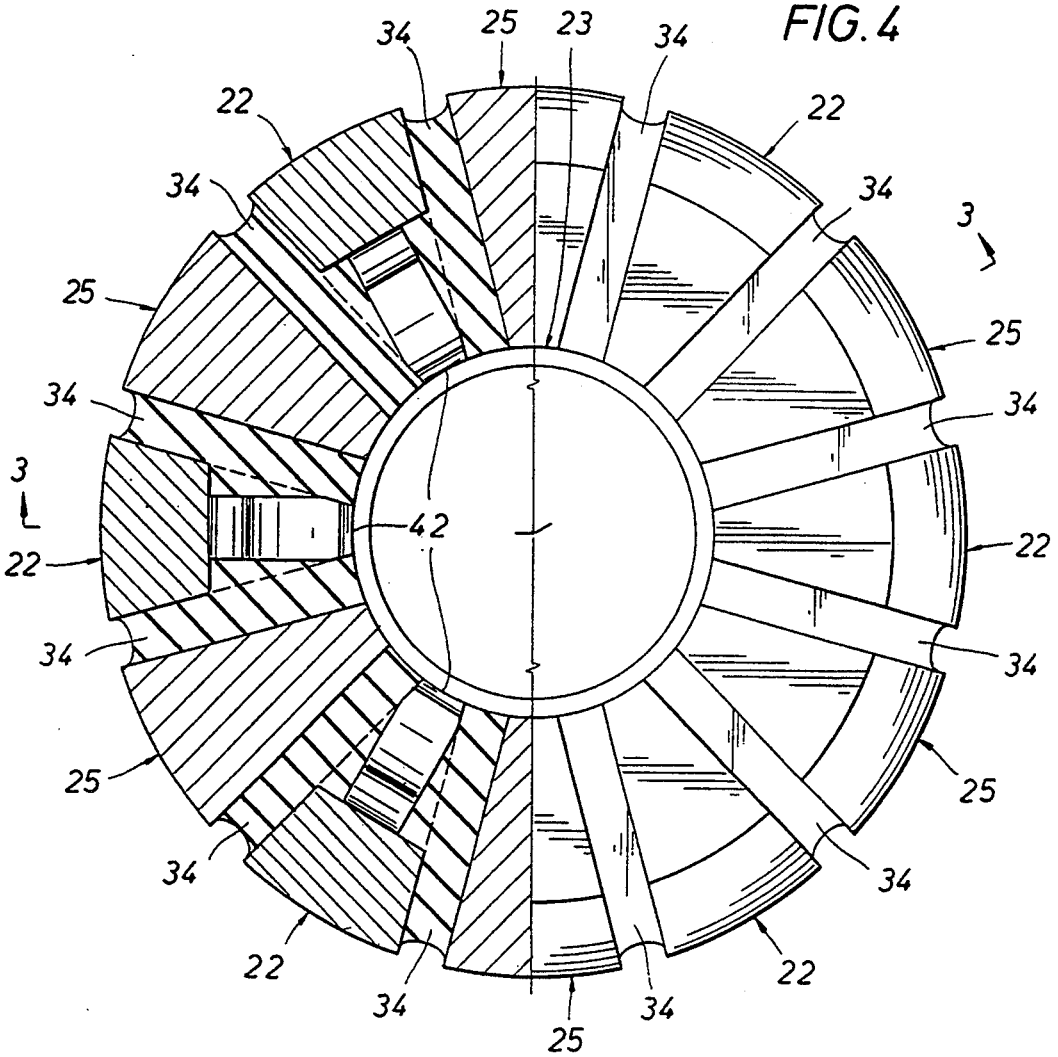
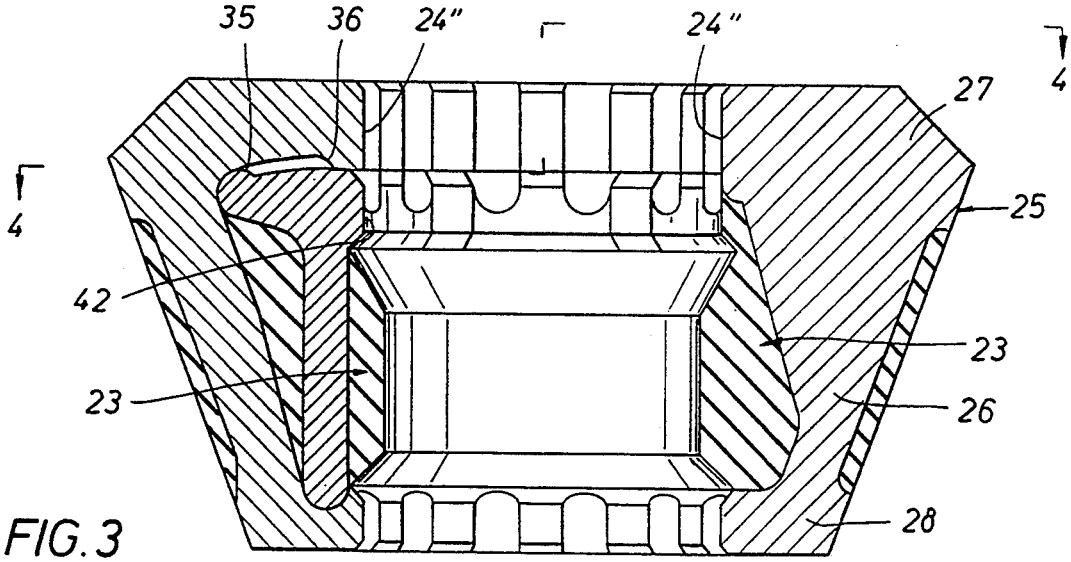
FIG. 3

42
50
24"
25
50
24d
24d
50
25
50
25
24"
40
50
42
24"
5
5
42
24d
24d
42
50
42
50
24"
M
M
25
25
50
50
42
22
24d
24d
50
24"
50

25
24b
24"
40
36
24b
6
19
42
M
24d
22
6
41
24d
41
29
29
24a
24a
24d
24d
24c
24c

FIG. 7
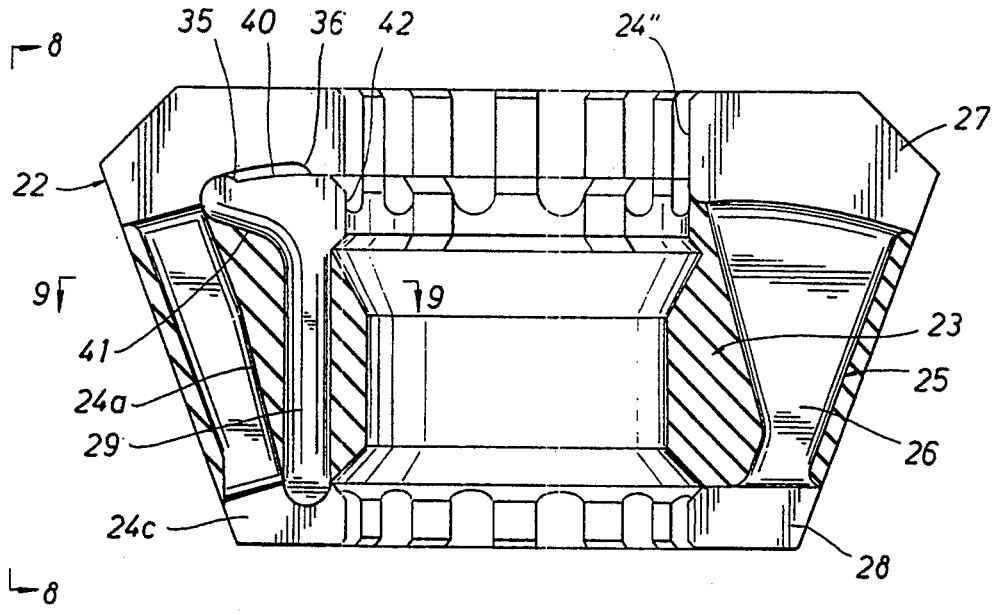
FIG. 9
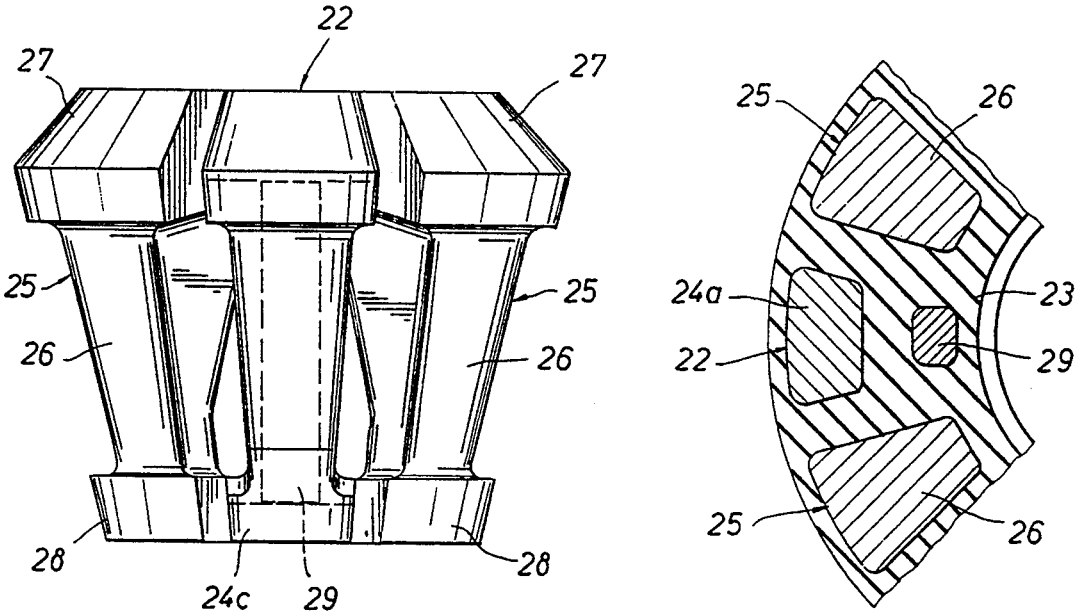
FIG. 8

FIG. 12
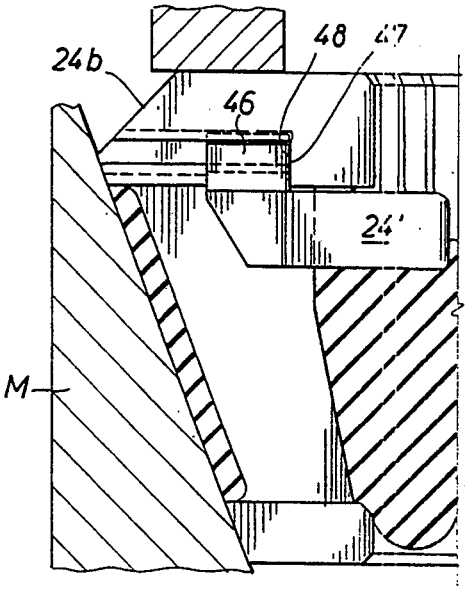
FIG. 13
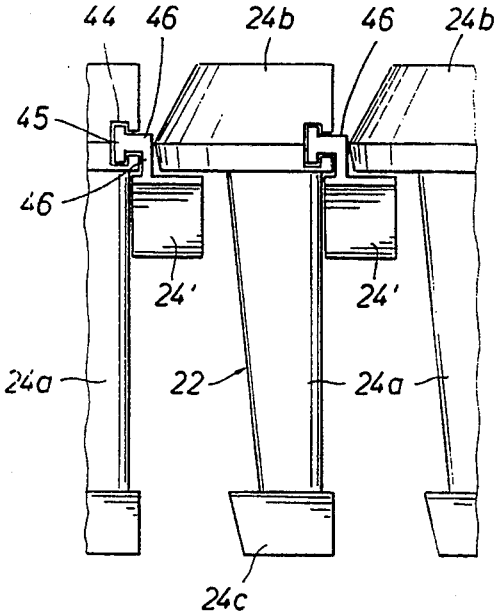
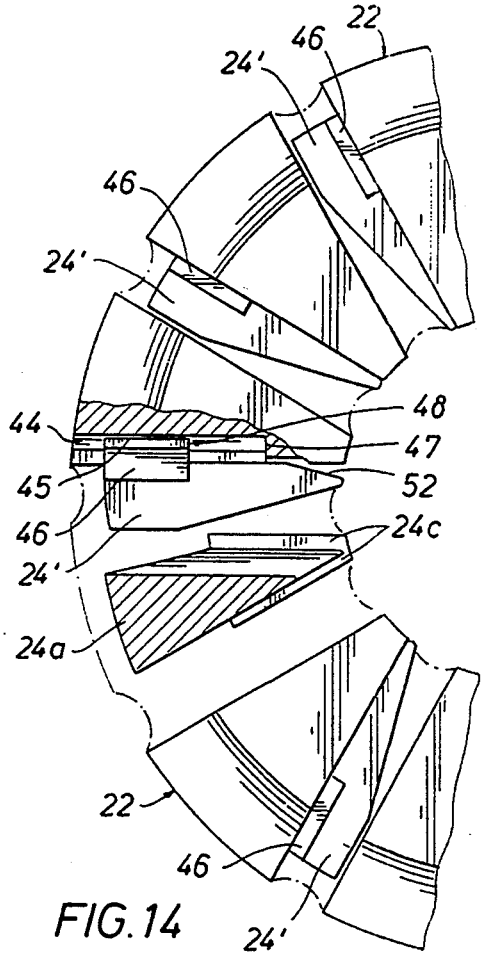
FIG. 14
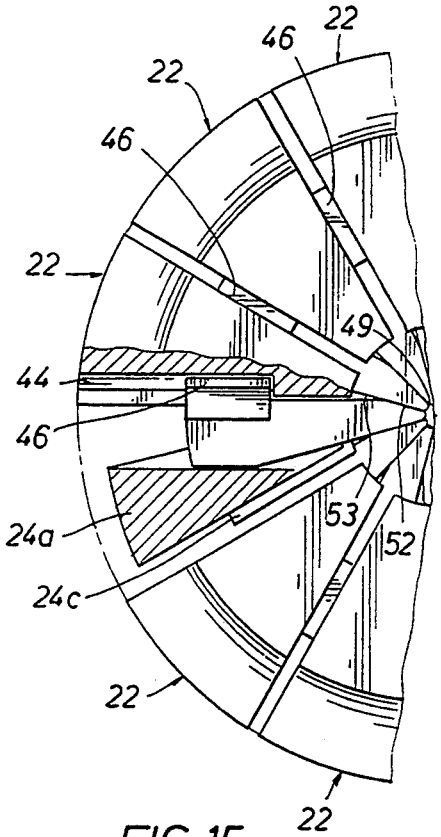
FIG. 15

ANNULAR PACKER AND INSERT

STATEMENT OF THE PRIOR ART

Various types of annular packers have been proposed and are in use for closing off axial bores in various devices, such as by way of example only, an annular blow out preventer. Such packers have heretofore employed an annular elastomeric body in which is embedded metallic inserts circumferentially spaced about an axial bore in the packer. The inserts have heretofore included a longitudinally extending web connected with a plate at its upper end and a plate at its lower end.

When a compressive force is applied to the outside of the packer, the inserts are moved inwardly by the elastomer as it is collapsed by the compressive force. This moves the inserts circumferentially toward each other as they move inwardly and squeezes the elastomer out from between the movable elements into the packer axial bore to seal with a member such as, by way of example only, a pipe or the like, or if no member is in the axial bore, then the elastomer seals with itself as it is forced into the axial packer bore.

As the inserts move inwardly toward the packer axial bore, the upper and lower plate of the inserts move into the packer axial bore to reduce the axial bore diameter and inhibit extrusion of the elastomer in any remaining opening in the axial bore as it is collapsed.

When no pipe extends through the axial bore of the blow out preventer, the packer must close upon itself in a complete shut off to close off the axial bore therethrough. When a device such as by way of example only, a blow out preventer, is actuated in a well known manner to close the axial bore in the packer to seal around a pipe or to close the packer axial bore to a complete shut off when no pipe is extending therethrough, the circumferentially spaced inserts move inwardly into the axial bore and toward each other, as above described.

This movement towards the center of the axial bore in the packer with present insert configurations leaves a central diameter portion of the elastomer body unsupported in the packer axial bore which in many instances may be as much as one half the diameter of the axial packer bore opening. Repeated extrusion of the elastomer through this opening leads to failure of the packer.

SUMMARY OF THE INVENTION

The present invention provides an arrangement to further reduce the size of the unsupported diameter of the elastomer in the bore of the packer which increases the performance and life of the packer.

An object of the invention is to provide an insert for an annular elastomer body having an axial bore, which insert includes a movable element that is movable into the elastomer body axial bore inwardly beyond the upper and lower plates of the insert in response to a circumferential compressive force applied to the elastomer body.

Still another object of the invention is to provide an insert for an elastomer packer body with an axial bore therein, the insert including an upper plate, a lower plate with a web extending therebetween and connected with the upper plate and the lower plate, and a movable element supported by the insert for accommodating movement of the movable element relative to the insert.

A further object of the invention is to provide an insert for an elastomer packer body that has an axial bore wherein the insert includes an upper plate, a lower plate with a web extending therebetween and connected with the upper plate and the lower plate, a movable element having a lower end supported on the lower plate to enable the movable element to pivot relative to the web, lower plate and the upper plate and a lateral projection adjacent the upper end of said member for extending inwardly beyond the upper plate into the axial bore when the elastomer is collapsed toward the packer axial bore to reduce the size of unsupported elastomer when the packer axial bore is closed.

An object of the invention is to provide an insert for an elastomer packer body that has an axial bore wherein the insert includes an upper plate, a lower plate with a web extending therebetween and connected with the upper plate and the lower plate, a movable element having a lower end supported on the web to enable the movable element to pivot relative to the web, lower plate and the upper plate and a lateral projection adjacent the upper end of said member for extending radially beyond the upper plate into the axial bore when the elastomer is collapsed toward the packer axial bore to reduce the size of unsupported elastomer when the packer axial bore is closed.

Still a further object of the invention is to provide an insert for an elastomer packer body that has an axial bore wherein the insert includes an upper plate, a lower plate with a web extending therebetween and connected with the upper plate and the lower plate, a movable element supported by the upper plate to enable the movable element to move relative to the web, lower plate and the upper plate for extending radially beyond the upper plate into the axial bore when the elastomer is collapsed toward the packer axial bore to reduce the size of unsupported elastomer when the packer axial bore is closed.

Yet a further object of the invention is to provide an improved insert for use in an annular elastomer packer with a bore therein, including an articulated element movable inward relative to the insert.

BRIEF DESCRIPTION OF THE DRAWINGS

FIG. 3 is an enlarged sectional view on the line 3—3 of FIG. 4 showing further details of the FIGS. 1 and 2 insert form of the present invention and its arrangement with another form of insert in an elastomer body;

FIG. 4 is a sectional view on the line 4—4 of FIG. 3 to illustrate further details of the packer of FIG. 3;

FIG. 7 is a sectional view similar to FIG. 3 showing the inserts in elevation;

FIG. 8 is a side view on the line 8—8 of FIG. 7 with the annular elastomer packer body of FIG. 7 omitted to better illustrate the arrangement of the forms of inserts in the elastomer packer body seen in FIGS. 1–9;

FIG. 9 is a sectional view on the line 9—9 of FIG. 7 showing in greater detail in horizontal cross section one form of the insert of the present invention in alternate circumferential relation with the other form of insert as seen in FIGS. 1–9;

FIG. 12 is an enlarged partial view of a packer supported by a piston and showing in greater detail the form of the insert of the present invention shown on the left hand side of FIG. 11;

FIG. 13 is a view showing one manner of supporting the movable element of the insert form of the present invention of FIGS. 12–15 when it is supported on the upper plate;

FIG. 14 is a partial top view with the elastomer removed to better show the circumferential arrangement of the insert form of FIGS. 12–15 in a packer; and FIG. 15 is a top view with the elastomer removed showing the position of the movable element of each insert when the elastomer packer body is collapsed to move the insert form of FIGS. 12–14 inward beyond the insert upper plate inner edge into the axial bore.

DESCRIPTION OF THE PREFERRED EMBODIMENTS

Figure 2:
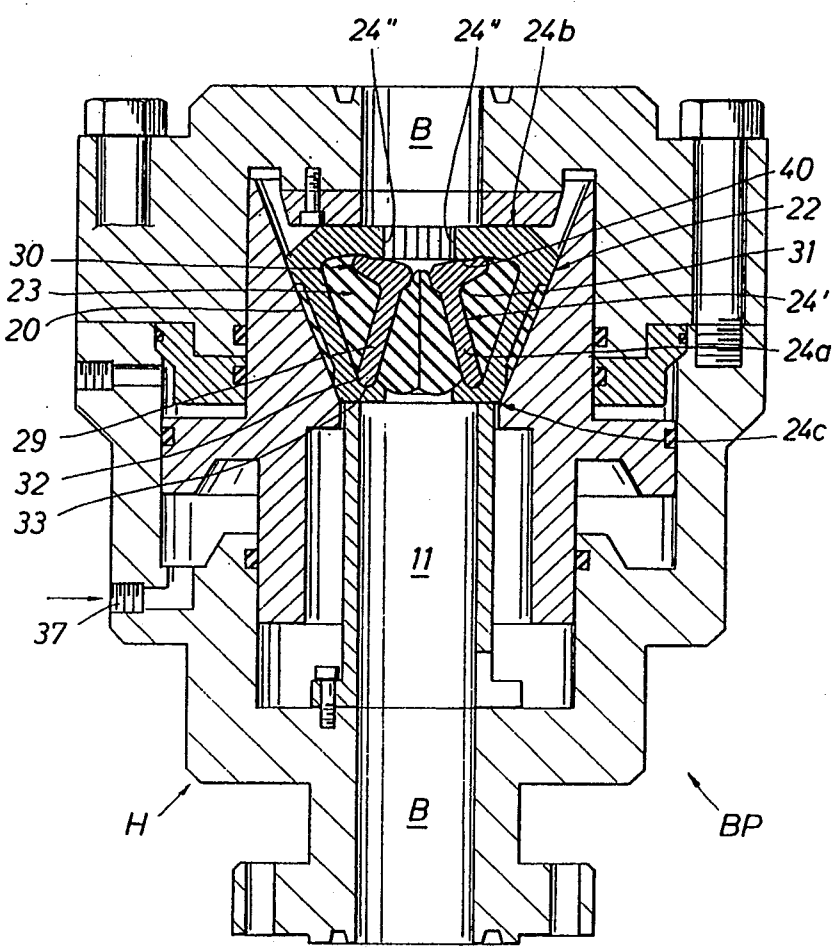
FIG. 2 is a vertical sectional view similar to FIG. 1 showing the elastomer body and insert form of FIG. 1 in complete shut off position in the blow out preventer.

Attention is first directed to FIGS. 1 through 9 wherein one form of the present invention is shown in connection with a device, by way of example only and not by way of limitation, an annular blow out preventer represented generally by the letters BP. However, such showing is by way of example only as the insert of the present invention may be employed in any apparatus where it is desired to employ a packer, referred to generally at P to control flow through a passage in a device or to seal with a pipe, conduit or other member in the passage.

The preventer BP includes a housing referred to generally at H of any suitable form well known to those skilled in the art with an axial bore B therein. A member represented generally by the letter M of any suitable form is supported by the housing in any suitable manner so that the member M can move to exert an external compressive force on the annular elastomer body 23 of the packer P to close off the axial bore 21 in the packer or to seal with a pipe, conduit or other element in the packer bore 21.

The housing H may be formed of components in any well known manner which components are secured together in any suitable manner such as by bolts or the like as shown in the drawings. Suitable annular seals as shown at S may be employed to seal between the housing components and elsewhere to provide a fluid tight arrangement.

In the form of housing illustrated, the bore B includes an annular cavity C that is coaxial with the bore B of the blow out preventer. The cavity C is of larger diameter than the bore B, and surrounds a longitudinal portion of the bore B as illustrated in the drawings. The packer referred to generally at P is positioned in the cavity C and is shown as supported on the support 10 which has a bore 11 coaxial with each the housing bore B, cavity C and packer axial bore 21.

The movable member M, is slidably and sealably positioned in the cavity C of housing H in any suitable manner as shown in the drawings. The member M may assume any desired configuration to accomplish the inward collapse of the elastomer packer body. As shown,the member M includes an inner annular tapered surface 19 which conforms to and abuts the outer annular tapered surface 20 of the elastomer body referred to generally at 23 of packer P.

The Inserts of the present invention are referred to generally at 22 and generally may assume any configuration desired to support a movable element referred to generally at 24' to accomplish the desired result of moving into and reducing the diameter of the axial bore 21 of the packer P and providing additional support to the elastomer that moves into the bore 21 when an external compressive force is applied to the packer P. In the form illustrated, the inserts 22 include a longitudinally extending web 24*a*. The web 24*a* extends between and is connected with a top plate referred to generally at 24*b* and a bottom plate referred to generally at 24*c*. The webs 24*a* of the inserts 22 have an arcuate outer surface 24*d*. The top plates 24*b* of the inserts 22 each have an inner edge surface 24". The webs 24*a* of the inserts 22 are embedded in the elastomer body 23 of the packer P as shown in the drawings.

In one form, the insert 22 includes a movable element, referred to generally at 24' which has a longitudinally extending portion or arm 29 and a laterally projecting portion, referred to generally at 30, adjacent the upper end 31 of the arm 29. The laterally extending portion 30 is preferably provided with an upper surface 40, a lower surface 41 and an inner edge surface 42 extending between the upper surface 40 and lower surface 41 as seen in the drawings. In FIGS. 1–9 of the drawings, the lower end 32 of the arm 29 is suitably shaped to be received and supported in the arcuate groove or seat 33 in the bottom, or lower plate 24*c*.

Figure 10:
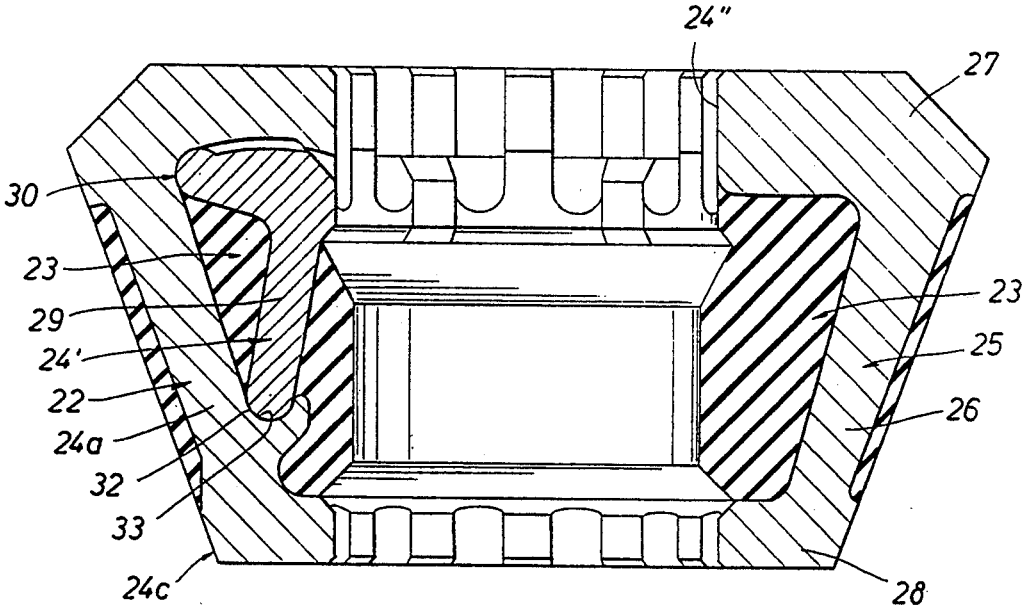
FIG. 10 is a sectional view of another form of the insert of the present invention and also showing in elevation the other insert in the packer elastomer body.

FIG. 10 shows another form of insert 22 which has the same components described and numbered with regard to the insert form of insert 22 of FIGS. 1–9 above described but the arm 29 of movable element 24' is seated on, or supported by the web 24*a* as seen in FIG. 10.

The foregoing arrangement of the movable element on the lower plate 24*c*, or on the web 24*a* accommodates movement, or pivoting of the movable or articulated element 24' in the arrangement shown in FIGS. 1–10 when a radial compressive force is applied externally to the packer P as will be described.

FIGS. 11–15 show another form of the insert 22 of the present invention where the movable element 24' is supported by the upper plate, as will be described.

The forms of insert 22 shown in FIGS. 1–15 of the drawings of the present invention may be employed alone in the packer elastomer body 23 or may be employed along with another form of insert, referred to generally at 25. The insert 25 comprises a web 26, an upper plate 27 and a lower plate 28 as shown in FIG. 3, but does not have a movable element. When the insert 25 is employed with the insert 22, the web 26 of insert 25 is also embedded in the elastomer packer body 23 which elastomer body 23 extends between the upper plate 27 and lower, or bottom, plate 28 of insert 25, as seen in FIG. 3 of the drawings.

When the inserts 22 and 25 are used together in the packer elastomer body 23, the inserts 22 and 25 preferably alternate circumferentially about the packer axial bore 21 as better seen in FIGS. 3–11.

Figure 11:
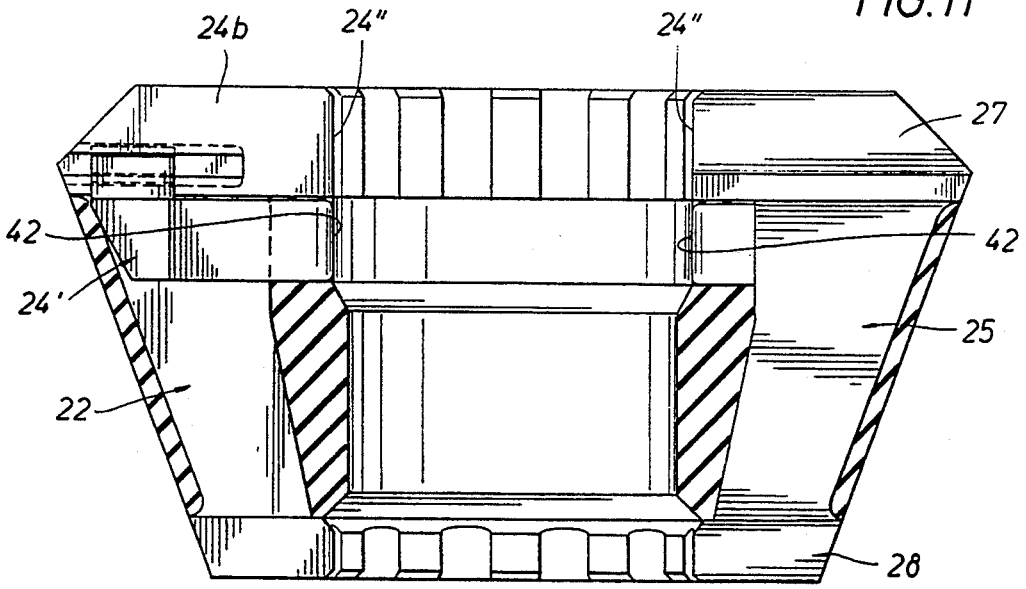
FIG. 11 is a sectional view of still another form of the insert of the present invention on the left hand side and also showing in elevation on the right hand side the other insert which may be employed in the packer elastomer body along with the insert of the present invention.

The insert form 22 shown in FIGS. 11–15 may be employed with the insert 25 as shown in FIG. 11, or the insert form 22 may be employed by itself in the packer P as illustrated in FIGS. 12–15.

Since the web of each of the inserts 22 and 25 is embedded in the elastomer body 23, the inserts 22 and 25 are circumferentially spaced in the elastomer body 23 about the packer axial bore 21 by the radially extending elastomer portions 34 between each of the inserts 22 and 25, as better illustrated in FIG. 4 which shows the packer in a relaxed, or uncollapsed position.

The inserts 22 and 25 are formed of metal or any other suitable substance that can withstand the external compressive force applied during closing of the packer on itself or on a tubular member or other type element that may be in the bore 21. The annular packer elastomer body 23 with inserts 22 and 25 therein, or with only inserts 22 is formed, or molded in a manner well known in the art which forms no part of the present invention.

As shown in the drawings, the movable or articulated element 24' is capable of moving inward radially into the axial packer bore 21 beyond and relative to the insert 22 as will be described.

The insert 22 includes means to limit the movement of the movable element relative to the insert 22 to aid in maintaining the movable element 24' on the insert. In FIGS. 1–11, The laterally extending portion 30 of movable element 24' in its preferred form includes a surface 35 projecting upwardly from the upper surface 40 of laterally projecting portion 30, which surface 35 is engageable with surface 36 depending from the lower surface 41 of the top plate **24*b* to limit the pivoting of the movable or articulated element 24' relative to insert 22 and thus maintain it on insert 22**.

Figure 1:
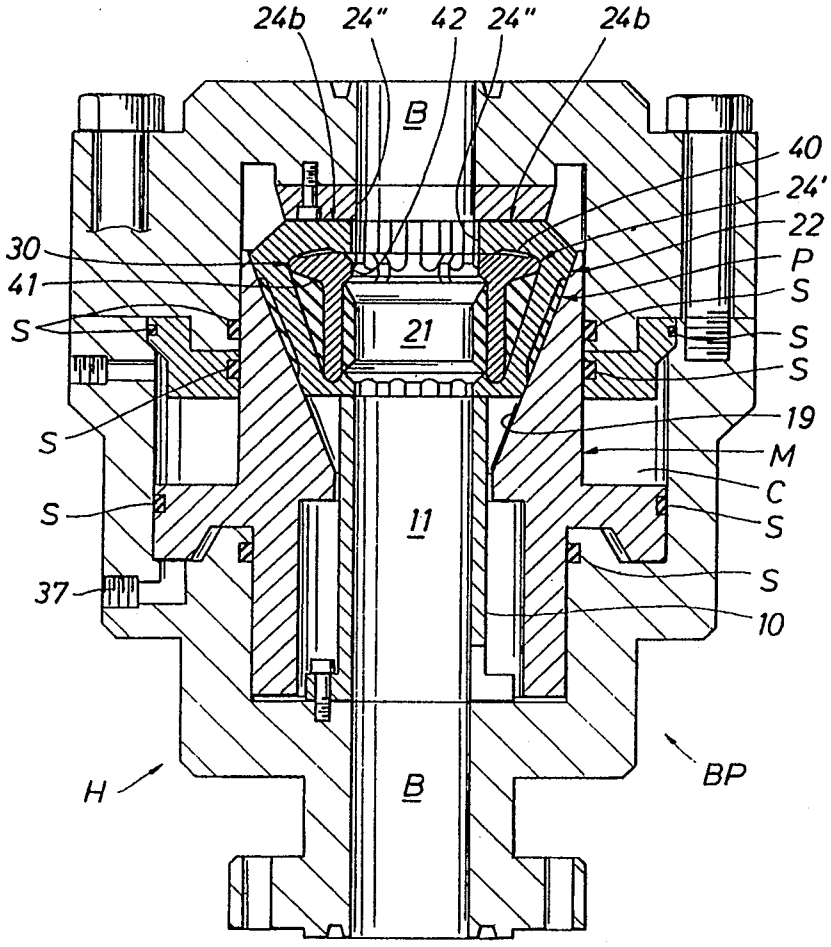
FIG. 1 is a vertical sectional view showing one form of the insert of the present invention circumferentially spaced in the elastomer body of a device, such as an annular blow out preventer.

FIG. 1 shows the blow out preventer with no pipe or other type element extending therethrough. If it becomes desirable to close off the bore B of the preventer with nothing in the bore B of the preventer BP and hence nothing in the bore 21 of the packer P, the elastomer packer must be collapsed on itself to close off bore. 21 as shown in FIG. 2.

Heretofore, inserts of varying form, but generally of the form of insert 25 above described have been employed in elastomer packer bodies. When a radial, external compressive force is applied to an elastomer packer with this prior art type of insert, its radial movement generally may not close off the bore 21 enough to eliminate or at least substantially reduce the extrusion of the elastomer body 23 of the packer upwardly through the opening between the inner edges 24'' of upper plates 27 so as to inhibit damage to the elastomer body 23 of the packer. Repeated extrusion of the elastomer body 23 through the opening between the upper plates 27 in the bore 21 which defines the unsupported part of the elastomer packer body 23 by the prior art inserts may cause substantial damage and tearing of the elastomer body 23 so that it must be replaced. Also the damaged parts my fall into a well bore when the blow out preventer is secured in relation to a well bore.

The problem is accentuated by repeated closing of the annular elastomer body 23 upon itself, and a similar problem is present when a tubular member or other type element is present in the bore B of the preventer and in the bore 21 of the packer, but the problem may not be as great since some of the packer axial bore 21 is filled by the tubular member or other type of element.

An inlet 37 is provided for supplying fluid pressure internally to the Housing H in the cavity C below the movable member M, shown in FIG. 1, to move it longitudinally of the housing H. When the member M is moved upwardly in response to fluid pressure, it applies an external compressive force to the elastomer packer body 23 to collapse it inwardly, either upon itself, or upon a tubular member or other type element in the bore 21 of the packer P.

Since the web **24*a* and the movable element 24' are embedded in the elastomer body 23 as shown in the drawings, the radial compressive force applied externally by movement of the member M moves the elastomer packer body 23 inwardly, including the portion 34 of the elastomer body between each of the inserts 22 and 25 when they are used together in the packer body P, or between circumferentially spaced inserts 22 when only that form is employed in the packer body 23. Movement of the inserts 25 and 22, when they are used together, moves the movable elements 24' on inserts 22 circumferentially positioned about the packer axial bore 21 into the packer axial bore 21 to close it off against a member in the axial bore, or to close the elastomer packer on itself to close off the axial bore 21 therethrough. When the packer P is closed upon itself or a tubular member or other type element in the bore 21**, fluid flow through the bore of the packer is stopped.

The movable elements 24' move inwardly of the inner ends 24'' of upper plates **24*b*, 27 of inserts 22, 25, respectively to further reduce the open space in the axial bore 21 and further minimize extrusion of the elastomer body 23 through the opening remaining between the inner ends of the inserts 22 which provides additional support to the elastomer body 23 forced into the axial bore 23**.

Figure 6:
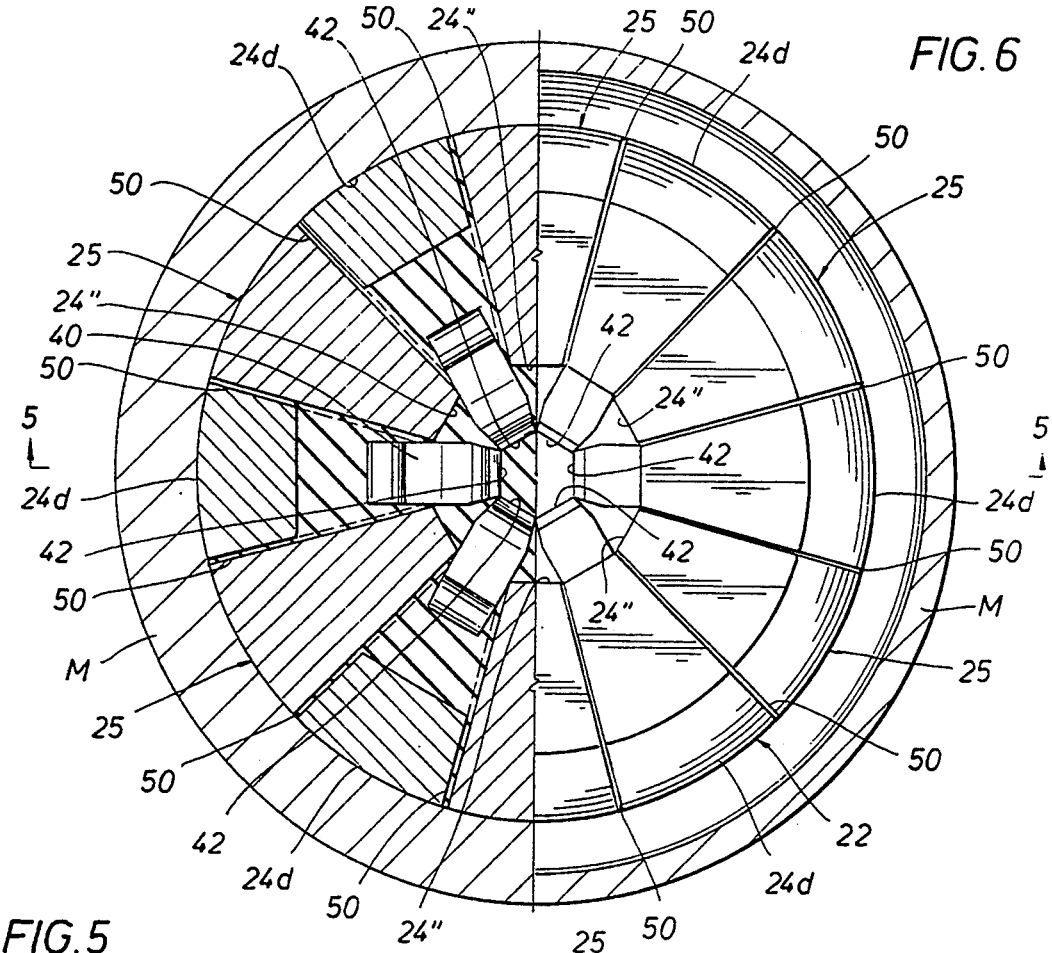
FIG. 6 is a sectional view on the line 6—6 of FIG. 5 showing in greater detail the position of the insert arrangement of FIGS. 1 and 2 when moved into the packer axial bore.
Figure 5:
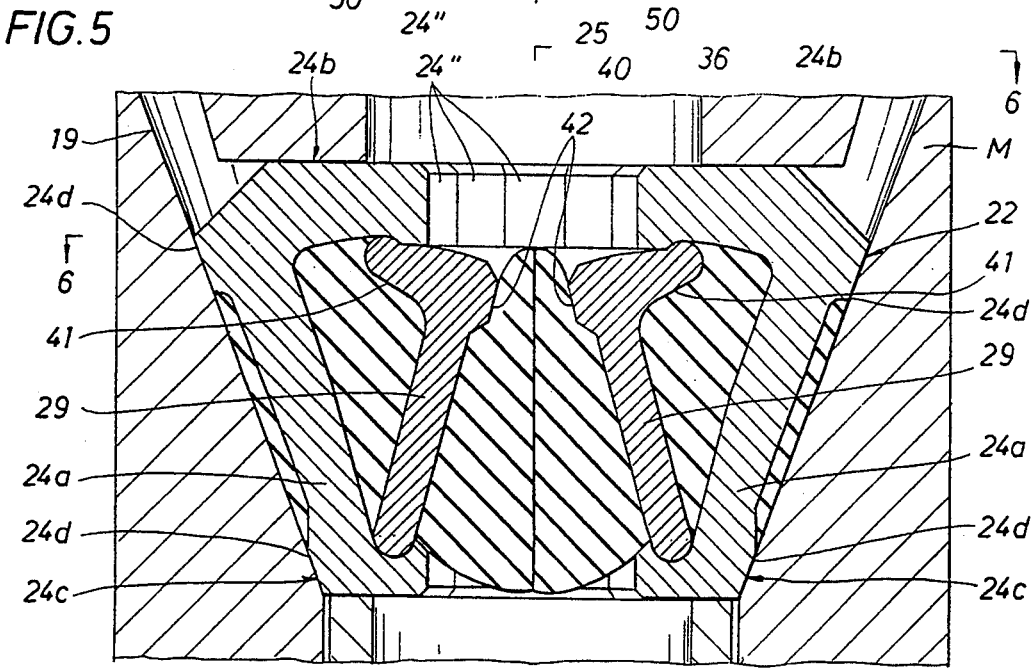
FIG. 5 is a sectional view on the line 5—5 of FIG. 6 showing an enlargement of the insert form and arrangement in the elastomer body of FIG. 2 when the inserts have been moved inward into the axial bore of the elastomer body.

When the elastomer body 23 is forced into the packer axial bore 21 by the compressive force of member M, only a small amount of elastomer packer body 23, as represented at 50 in FIG. 6, remains between the circumferentially, alternately spaced inserts 22, and 25 of FIGS. 1–11 or between the circumferentially spaced inserts 22 when used without inserts 25 as illustrated in one example in FIGS. 12–15.

In use of the elastomer packer P and insert 24' of the present invention, the prior problems caused by extrusion of the elastomer body 23 may be substantially reduced, if not eliminated, because the movable articulated member 24' is forced beyond the inner edges 24'' of the upper plates **24*b* of each of the circumferentially, positioned and spaced inserts 22 and into the bore 21 of the packer even though the top plate 24*b* of the insert 22 is also moved into the bore 21 of the packer P in response to the radial compressive force. Thus, more surface of the elastomer body 23 of the packer 23 is supported by the movable element 24' of the insert 22 of the present invention and the amount of surface of the collapsed elastomer body 23** that is left unprotected is reduced.

Where the insert 22 with the pivotally movable element 24' is employed alone in circumferentially spaced relation in the elastomer body 23, the inner ends 42 of the laterally extending portion 30, which project into the axial bore 21, may be made more narrow to enable the insert 22 forms to close off more of the axial opening in the elastomer body.

In FIGS. 12–15, another form of insert 22 is shown that may be positioned in circumferentially spaced relation in the elastomer body 23. In this form of the insert 22, the movable member 24' is supported by the upper plate **24*b* of the insert. The insert 22 includes the upper plate 24*b*, lower plate 24*c* and web 24*a* extending therebetween as previously described with regard to FIGS. 1–10. The movable element 24' is supported on the upper plate 24*b* for movement, or extension, laterally into the packer axial bore 21 relative to the inner end of 24'' upper plate 24*b***.

As seen in FIGS. 12–15, the elastomer packer P is of the same configuration as that previously described. FIG. 14 shows the position of the movable elements 24' on the upper plate **24*b* when the elastomer packer (not shown) is in relaxed, or uncollapsed position, and FIG. 15 shows the position of the movable elements 24' when the member M has forced the elastomer body 23 (not shown), including the elastomer body portion 34 between the inserts 22 in the elastomer body into the axial bore 21** (not shown).

The upper plates **24*b* of the inserts each include a slot, or keyway 44 in each upper plate 24*b* to slidably receive and maintain a key 45 therein. Each key 45 extends outwardly of the slot 44 and has a portion 46 that is connected with each of the movable elements 24' embedded in the elastomer body 23. This positions each of the movable elements 24' adjacent the web 24*a* of the insert 22 for movement radially inward into the axial bore 21 when the elastomer body 23 is collapsed inwardly by member M. Cooperating surfaces to limit the movement between the movable members 24' and the insert 22 in this form comprise the inner end 47 of the slot 40 and the inner end 48 of the key 45**.

It is desired to provide a maximum amount of support surface for the elastomer body 23 of the packer P when it is forced into the axial bore 21 by forming the smallest opening possible, represented at 49 in FIG. 15, in the packer axial bore 21 at the upper end of the elastomer body 23 of the packer P to maintain extrusion of the elastomer body 23 to a minimum in the axial bore 21.

The movable elements 24' may assume any desired form, and as shown in the FIGS. 11–15 form are provided with tapered, mating innermost edge surfaces 52, 53, better seen in FIGS. 14 and 15. This enables the innermost end portions of each of the circumferentially spaced movable elements 24' to move further into the axial bore 21 and contact the edges of adjacent movable elements 24' as shown in FIGS. 14 and 15 to form the smaller opening 49 in the axial packer bore 21 and provide maximum surface protection or support to the packer portion that is forced into the axial bore 21 when the packer is collapsed inwardly as previously described.

The foregoing disclosure and description are illustrative and explanatory thereof, and various changes in size, shape and materials as well as in the details of the illustrated construction may be made without departing from the scope of the invention which is more properly encompassed by the following claims.

What is claimed is:

1. An insert for a device having an annular elastomeric body with an axial bore, said insert including a movable element and a support on the insert to enable said movable element to move into the axial bore in said annular elastomeric body upon the application of an external compressive force on the annular elastomeric body.

2. The insert of claim 1 wherein said support is a bottom plate on the insert.

3. The insert of claim 2 wherein said movable element is supported by said bottom plate for pivotal movement of said movable element relative to the bore in the annular elastomeric body.

4. The insert of claim 1 wherein said support is a top plate on the insert.

5. The insert of claim 4 wherein said movable element is supported by said top plate for pivotal movement of said movable element inwardly relative to the bore in said elastomeric body.

6. The insert of claim 6 wherein said movable element is slidably supported by said top plate for lateral movement into the bore in the elastomeric body.

7. The insert of claim 3 wherein said top plate supports an extensible member for slidable movement thereon: said extensible member connected with said movable element whereby an external compressive force on the elastomeric body moves said extensible element into the axial bore.

8. The insert of claim 1 wherein said support is a web on the insert.

9. The insert of claim 8 wherein said movable element is supported by said web for pivotal movement relative to the bore in the elastomeric body.

10. The insert of claim 9 wherein said movable element includes a longitudinally extending arm with a lower end and an upper end, a laterally extending portion adjacent said upper end and wherein said lower arm end is supported by the web for pivotal movement of said movable element.

11. The insert of claim 1 wherein said movable element includes a longitudinally extending portion with a lower end and an upper end, a laterally extending portion adjacent said upper end and wherein said lower end is supported by said bottom plate for pivotal movement of said movable element relative to the bore in the elastomeric body.

12. The insert of claim 1, or 2 or 3, or 4, or 5, or 6, or 7, or 8, or 9, or 10 wherein the device is a packer.

13. The insert of claim 8 or 10 wherein said laterally extending portion of said movable element and said top plate each include a surface thereon engageable to limit the movement of the movable element relative to the bore in the annular elastomeric body.

14. A device including a packer for closing an axial bore in the device wherein the packer comprises:

an annulus of elastomeric material extending about the axial bore of the device forming an axial bore in the packer;

inserts in the elastomeric material spaced circumferentially about the packer axial bore and movable thereinto upon the application of an external force to the elastomeric material to reduce the size of the packer axial bore;

said inserts including a movable element responsive to the compressive force applied to said elastomeric material to move into the packer axial bore to further reduce the size of the packer axial bore.

15. The device of claim 14 wherein said inserts include:

a top plate;

a bottom plate;

said movable element having a lower end abutting said bottom plate for pivotal movement relative thereto and an upper end;

a laterally projecting portion extending from adjacent said movable element upper end; and engageable surfaces on said laterally extending portion and on said top plate to limit the pivotal movement of said movable element.

16. The device of claim 14 wherein said inserts include:

a top plate;

a bottom plate;

a web extending between said top plate and said bottom plate;

said movable element having a lower end abutting said web for pivotal movement relative thereto and an upper end;

a laterally projecting portion extending adjacent said movable element upper end; and engageable surfaces on said laterally projecting portion and on said top plate to limit the pivotal movement of said movable element.

17. The device of claim 14 wherein said inserts include:

a top plate;

a bottom plate;

said movable element including an extensible member supported by said top plate; and engageable surfaces on said extensible member and on said top plate to limit the movement of said movable element.

18. The device of claim 17, or 14, or 15, or 16 wherein the device is an annular blow out preventer and includes;

a housing for receiving the packer; and a movable member in said housing for applying an inward compressive force to said packer to move said movable element of said inserts into the axial bore of said blow out preventer.

19. The annular blow out preventer of claim 18 wherein the movable member surrounds said packer for applying the inward compressive force to said packer.

20. An improved packer for use in an annular blow out preventer having a longitudinal axial bore, the packer having an annulus of elastomeric material providing a longitudinal bore in the packer coaxial with the blow out preventer axial bore, the packer adapted for compressive inward displacement toward said axial bore and having inserts circumferentially spaced in the annulus of elastomeric material about said packer axial bore, said inserts each having a longitudinally extending web embedded in the elastomeric material and top and bottom plates at the top end and the bottom end of said web, respectively, with the packer embedding said webs and a movable element supported by said insert for movement inward into the packer axial bore beyond said top plate upon inward displacement of the packer to decrease extrusion of the elastomeric material.

21. The improved packer of claim 20 for use in an annular blow out preventer wherein said movable element includes a lower end and an upper end with the lower end supported by said bottom plate for pivotal movement of said movable element and a laterally extending portion on said upper end of said movable element with the result that during inward compressive displacement of the packer, said movable element pivots relative to said top and bottom plates to move said laterally extending portion radially inward into said packer axial bore beyond said top plate to decrease extrusion of the elastomeric material.

22. The improved packer of claim 20 for use in an annular blow out preventer wherein said movable element includes a lower end and an upper end with said lower end supported by said web for pivotal movement of said movable element and a laterally extending portion adjacent said upper end of said movable element with the result that during inward compressive displacement of the packer, said movable element pivots relative to said top and bottom plates to move said laterally extending portion radially inward into the packer axial bore beyond said top plate to decrease extrusion of the elastomeric material.

23. The improved packer of claim 20 for use in an annular blow out preventer wherein said movable element includes a member supported by said top plate with the result that during circumferential inward compressive force on the packer, said member moves into the packer axial bore beyond said top plate to decrease extrusion of the elastomeric material.

24. The insert of claim 16 or 20 wherein the web is connected with the top and bottom plate.

25. In an insert for a packer formed of an elastomeric material wherein the packer has a longitudinal bore and the insert includes a top plate and a bottom plate connected by a web embedded in the elastomeric material, the packer adapted for displacement toward the longitudinal bore, the improvement comprising:

a movable element supported by the insert including a portion for extending into the longitudinal bore beyond the top plate.

26. The insert of claim 25 wherein said movable element is articulated on the bottom plate.

27. The insert of claim 25 wherein said movable element is articulated on the web.

28. The insert of claim 25 wherein said movable element is articulated on the top plate.

29. The insert of claim 1 or claim 28 including cooperating surfaces on the insert and said movable element to limit the movement of said movable element into the bore.

30. An improved insert for use in an annular elastomeric packer with a bore therein, wherein the insert includes a web extending between a top and a bottom plate, the improvement comprising an articulated movable element between the top and bottom plates for moving into the packer bore beyond the top plate when a compressive force is applied to the annular packer.

31. The improved insert of claim 30 wherein the top plate and said articulated movable element each have a surface engageable to limit the inward movement of said articulated movable element into the packer bore beyond the top plate.

32. An improved insert for use in an annular elastomer packer with a bore therein, the improvement comprising a movable element supported by the insert for movement inward into the packer bore when a compressive force is applied to the annular packer.

* * * * *